United States Patent [19]

Harris

[11] 4,238,819

[45] Dec. 9, 1980

[54] SWIVEL SOCKET FOR LIGHTS

[76] Inventor: Edward H. Harris, 1065 E. Flamingo Rd., Apt. 524, Las Vegas, Nev. 89109

[21] Appl. No.: 950,778

[22] Filed: Oct. 12, 1978

[51] Int. Cl.[3] ..... F21V 21/30

[52] U.S. Cl. ..... 362/419; 362/235; 362/285; 362/408

[58] Field of Search ..... 362/147, 227, 235, 249, 362/250, 251, 269, 278, 285, 311, 404, 408, 418, 419, 421, 426, 427, 428, 429, 430

[56] References Cited

U.S. PATENT DOCUMENTS

| | | | |
|---|---|---|---|
| 285,277 | 9/1883 | Klein . | |
| 1,319,393 | 10/1919 | Hollis | 362/418 |
| 2,753,445 | 7/1956 | Thomas et al. | 362/408 X |
| 2,790,894 | 4/1957 | Zingone . | |
| 2,815,918 | 12/1957 | Wolar . | |
| 2,914,661 | 11/1959 | Winkler | 362/404 |
| 3,041,035 | 6/1962 | Pascucci . | |
| 3,188,794 | 6/1965 | Johnson . | |
| 3,378,221 | 4/1968 | Wolar et al. . | |
| 3,512,743 | 5/1970 | Lipscomb | 362/404 |
| 4,037,098 | 7/1977 | Kowalski | 362/418 |

FOREIGN PATENT DOCUMENTS

| | | | |
|---|---|---|---|
| 230959 | 10/1960 | Australia | 362/421 |

*Primary Examiner*—L. T. Hix
*Assistant Examiner*—Alan Mathews
*Attorney, Agent, or Firm*—Dowell & Dowell

[57] ABSTRACT

A socket apparatus for light tubes which normally extend downwardly a substantial distance from a fixture and in which the socket apparatus is swingably mounted relative to the fixture so that the light tubes may be plumb regardless of the attitude of the fixture.

6 Claims, 5 Drawing Figures

SWIVEL SOCKET FOR LIGHTS

SUMMARY OF THE INVENTION

The present invention relates generally to lighting fixtures of various kinds and is embodied particularly in a swivel socket which receives one end of an elongated light tube having a plurality of individual low wattage bulbs spaced along the length thereof. The socket includes a semi-spherical portion which is positioned in a cylindrical opening of the fixture and such opening is of a smaller diameter than the spherical dimension of the socket. A portion of the socket loosely receives a holding member which substantially prevents vertical and rotary movement of the socket while permitting limited movement about the vertical axis in a horizontal plane.

It is an object of the invention to provide a swivel socket for a light fixture which permits the light to be disposed along a substantially vertical axis even though the light fixture may be disposed at an angle to a horizontal plane.

Another object of the invention is to provide a swivel socket mounted in a fixture in such a manner that the socket can swing about a vertical axis for a limited amount while substantially preventing vertical and rotary movement along such axis.

DESCRIPTION OF THE PREFERRED EMBODIMENTS

Figure 1:
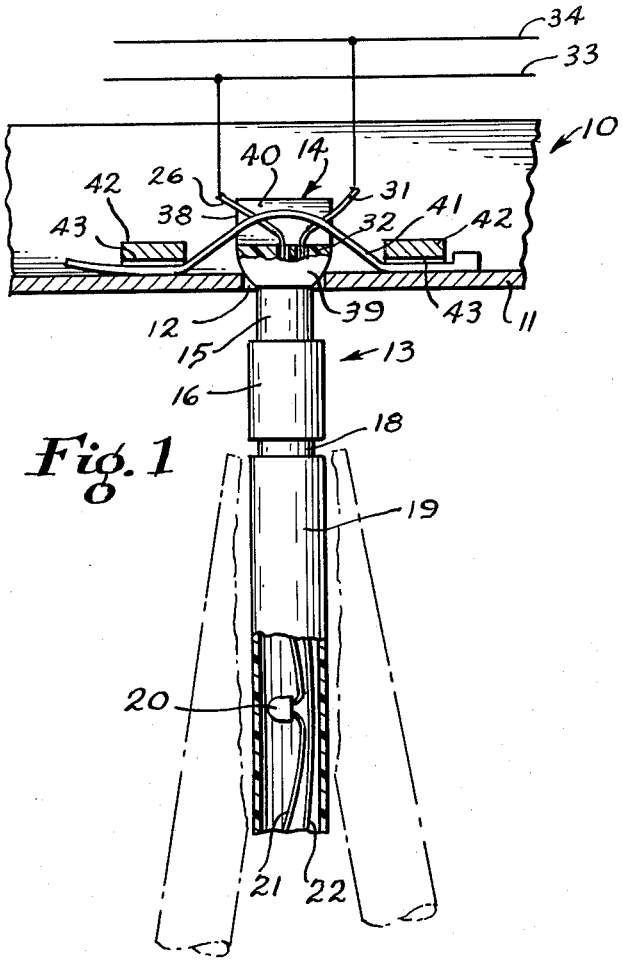
FIG. 1 is a side elevation with portions broken away and illustrating one application of the invention.
Figure 3:
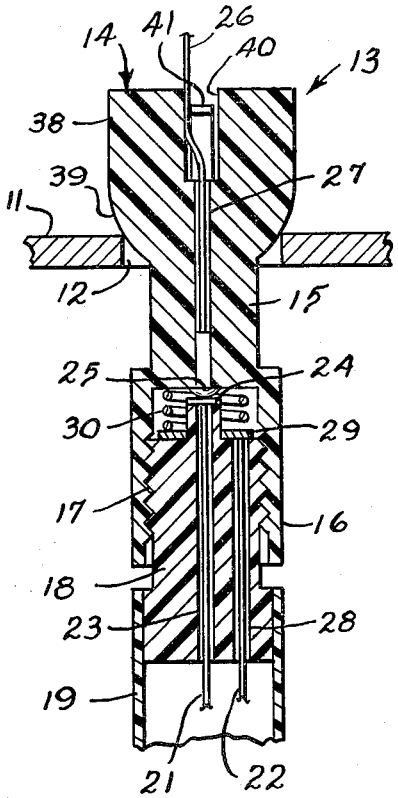
FIG. 3 is an enlarged section taken on the line 3—3 of FIG. 2.
Figure 2:
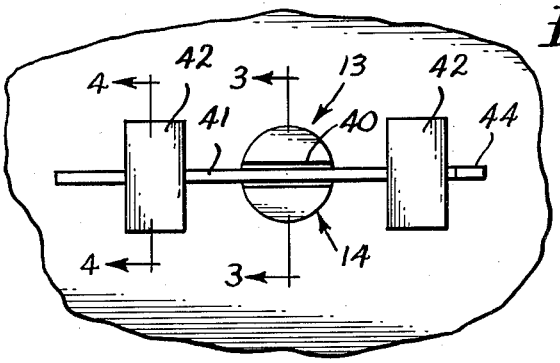
FIG. 2 is a top plan view thereof.

With continued reference to the drawing, a lighting fixture 10 is provided which normally is mounted on the ceiling of a room in such a manner that one or more lights depend from such fixture. The lighting fixture includes a bottom wall 11 having one or more generally circular openings 12 extending therethrough. Each of the openings receives a swivel type socket 13 having a head 14 connected by a reduced neck 15 to a body 16. Preferably the body 16 is generally hollow and is provided with internal threads 17 which threadedly receive the base of a light.

Although the socket 13 may be constructed of a size to receive a conventional light bulb, it is intended to be of a size to receive a relatively small base 18 of an elongated light tube 19 having a plurality of independent low wattage bulbs 20 spaced along its length. The light bulbs 20 may be connected either in series or in parallel by wires 21 and 22 and the light tube 19 may be either transparent or translucent depending upon the lighting effect desired. Also it is contemplated that the bulbs 20 or the tube 19 may be clear, white or colored, as desired.

The wire 21 of the light tube extends through a bore 23 in the base 18 thereof and such wire is connected to a contact 24 which in turn engages a contact 25 carried by the socket 13. The contact 25 is electrically connected to a wire 26 which extends through a bore 27 in the socket 13. The wire 22 of the light tube extends through a bore 28 in the base 18 and is connected to a contact 29 adjacent to the upper end thereof. A coil spring 30 is mounted within the body 16 of the socket and one end of such spring engages the contact 29 of the light tube while the opposite end is connected to a wire 31 which extends upwardly through a bore 32 in the socket. The wires 26 and 31 are connected to a suitable source of electrical energy such as a printed circuit or lead wires 33 and 34.

In order to permit the light tube 19 to be plumb or disposed along a vertical axis even if the lighting fixture 10 is disposed at an angle to a horizontal plane, the head 14 of the socket is provided with a generally cylindrical upper portion 38 and a substantially semi-spherical lower portion 39. Normally the semi-spherical portion 39 slidably engages the edge of the opening 12 in the bottom wall of the lighting fixture in such a manner that the socket may swing a limited amount in any direction with such swinging movement being limited by the thickness of the bottom wall 11 as well as the diameter of the neck 15 of the socket.

It is noted that instead of an opening 12 having generally cylindrical walls, as shown in the drawings, such opening could have generally frusto-conical walls which taper either upwardly or downwardly to a relatively sharp edge in which case the angle of movement of the socket 13 is increased.

Figure 4:
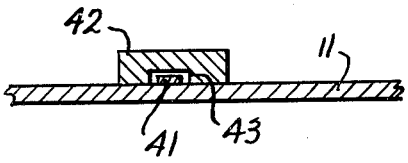
FIG. 4 is a section taken on the line 4—4 of FIG. 2.

With particular reference to FIGS. 1–4, in order to reduce or substantially prevent vertical movement of the socket 13 after the socket has been positioned within the opening 12, as well as to prevent rotary movement of such socket when a light is being screwed into or unscrewed from the socket, the cylindrical portion 38 of the socket head is provided with a diametrical slot or kerf 40 which extends the full width of the cylindrical portion and such slot receives a retaining member or flexible strap 41. Preferably, the strap 41 is made of thermoplastic material such as polyethylene, polypropolene or the like, however, it is contemplated that the strap could be made of any suitable natural or synthetic material. The opposite ends of the strap are restrained by a pair of anchor members or bridges 42 located on opposite sides of the opening 12 and secured to the upper surface of the bottom wall 11 in any desired manner, as by an adhesive or the like. Each of the bridges 42 is provided with a slot 43 which may be located either at the base of the bridge, as illustrated in FIG. 4 or such slot may be located intermediate the upper and lower surfaces thereof. One end of the strap 41 is provided with an enlargement 44 to prevent such end from passing through the bridge while the opposite end of such strap preferably extends substantially beyond the bridge.

The bridges 42 are located close to the opening 12 so that the strap is bent upwardly at a relatively sharp angle to pass through the slot 40 of the socket and such sharp bend resists movement of the strap through the slots 43 of the bridges. Also it is noted that the upper surface of the flexible strap could be serrated in a direction normal to the length of the strap so that the serrations engage the corners of the bridges and additionally resist movement of the strap. In this manner the socket 13 may be swung along the direction of the strap without substantially moving such strap and due to the flexibility of the strap the socket may be moved in a direction normal to the length of such strap; however, since opposite ends of the strap are substantially anchored, the strap resists axial as well as rotary movement of the socket.

Figure 5:
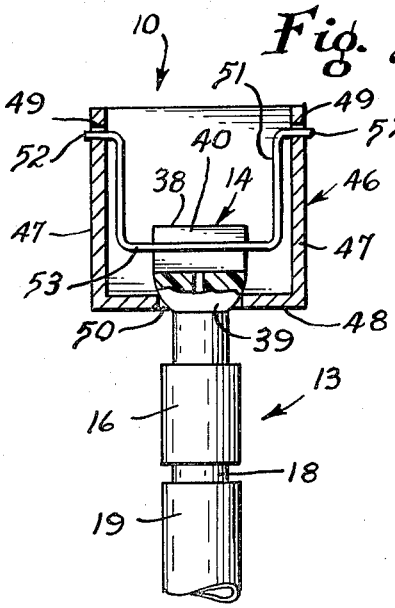
FIG. 5 is a side elevation with portions broken away illustrating another embodiment of the invention.

With particular reference to FIG. 5, another embodiment of the invention is illustrated in which the lighting fixture is disclosed as being a U-shaped channel 46 having generally parallel side walls 47 connected by a bottom wall 48. Each of the side walls 47 includes an opening 49 adjacent to the upper end and substantially in a vertical plane with an opening 50 in the bottom wall 48. The opening 50 serves the same purpose as the opening 12 in the previous embodiment. A generally U-shaped retaining member or wire bail 51 is provided having outwardly extending ears 52 which are received within the openings 49 to pivotally mount the bail in a position such that the bail hangs downwardly, as illustrated in FIG. 5. The bight portion 53 of the U-shaped bail is received within the slot 40 of the socket 13 so that when the socket is moved longitudinally of the bight portion, the bail 51 remains substantially in the same position, and when the socket is moved transversely of the bight portion, the bail pivots about the ears 52. Vertical movement of the socket 13 is resisted by the bight portion 53 of the bail engaging the bottom of the slot 40 of the socket and rotary movement of the socket is prevented by the bight portion of the bail engaging opposite sides of such slot.

In the operation of the device, the body 16 and neck 15 of the socket 13 are inserted through the openings 12 or 50 of the lighting fixture; however, the head 14 is of a size such that the head cannot pass through such opening. Instead the semi-spherical portion 39 rests on the corner defined by the bottom wall of the fixture and the side walls of such openings. The wires 26 and 31 are electrically connected to the lead wires 33 and 34 and thereafter the flexible strap 41 is inserted through the slot 43 of one of the bridges 42 and then through the slot or kerf 40 in the cylindrical portion 38 of the socket head, after which the end of the strap is pushed through the slot 43 of the opposite bridge. In this position the socket 13 is free to swivel a limited amount in any direction; however, when the light tube 19 is inserted into the socket, upward movement of the socket is resisted by the flexible strap 41. When the wire bail 51 is being used, the socket 13 is inserted through the opening 50 in the bottom wall of the channel member 46, after which the ears 52 of the wire bail 51 are sprung toward each other and inserted into the fixture until the bight portion 53 enters the slot or kerf 40 of the socket. The ears 52 are aligned with the openings 49 and then released so that the ears spring outwardly into pivotal engagement with such openings. Both the strap 41 and the bail 51 prevent rotary motion of the socket 13 so that the base of the light may be screwed into or unscrewed from the socket.

I claim:

1. A socket means for supporting a light from a lighting fixture having a bottom wall with at least one circular opening of predetermined diameter extending therethrough, said socket means comprising a body having an enlarged head at one end, said head including a semi-spherical portion which is larger than the diameter of the circular opening and slidably engages the edges thereof, said body being of a size to pass through said opening, means within said body for receiving and supporting a light, said head having slot means extending in one direction from side to side thereof, and retainer means carried by the fixture and having portions extending through said slot means so that said head is movable in said one direction, said portions of said retainer means being movable so that said head is movable in a direction normal to said one direction, whereby said socket means may circumgyrate relative to the fixture but axial and rotational movement is substantially prevented.

2. The structure of claim 1 in which said retainer means includes an elongated flexible strap, and means carried by the fixture on opposite sides of the circular opening for receiving opposite ends of said strap.

3. The structure of claim 1 in which said retainer means includes a bail pivotally mounted on the fixture.

4. The structure of claim 1 including a pair of wires extending through said body and connecting the light to a source of electrical energy.

5. The structure of claim 1 in which said head includes a generally cylindrical portion integrally connected to said semi-spherical portion, and said slot means being located within said cylindrical portion.

6. The combination of a lighting fixture and a socket member movably mounted therein comprising a hollow lighting fixture having a bottom wall with at least one opening therethrough, said opening being of predetermined diameter, said socket member including a hollow body connected by a reduced neck to an enlarged head, means within said body for receiving one end of an elongated light tube member, said body and said neck being of a size to pass through the opening in said bottom wall, said head having a lower semi-spherical portion integrally connected to an upper generally cylindrical portion, said semi-spherical portion being larger than the opening in said bottom wall and slidably engaging the edges thereof, said upper cylindrical portion of said head having a diametrically disposed slot extending in one direction, retainer means carried by said fixture, means for anchoring portions of said retainer means on opposite sides of said opening, and a portion of said retainer means intermediate said anchoring portions being received within said slot so that said head is movable in said one direction, said intermediate portion being movable so that said head is movable in a direction normal to said one direction to permit said socket member to circumgyrate about the connection between said head and said bottom wall while substantially preventing axial and rotational movement of said socket member.

* * * * *